US005320257A

United States Patent [19]

Snedden

[11] Patent Number: 5,320,257

[45] Date of Patent: Jun. 14, 1994

[54] RESILIENT AMPULE WITH ARTICULATING LINKAGE AND ELONGATE SPOUT

[76] Inventor: John Snedden, P.O. Box 1669, Sandpoint, Id. 83864-0871

[21] Appl. No.: 765,669

[22] Filed: Sep. 26, 1991

[51] Int. Cl.[5] ..... B65D 31/00

[52] U.S. Cl. ..... 222/215; 222/529; 222/541; 206/438

[58] Field of Search ..... 222/206, 207, 209, 210, 222/215, 541, 420, 212, 529, 572; 604/216, 217, 275; 206/438

[56] References Cited

U.S. PATENT DOCUMENTS

| | | | |
|---|---|---|---|
| 69,485 | 10/1867 | Robbins | 222/209 |
| 1,739,288 | 12/1929 | Brown | 222/541 X |
| 2,107,106 | 2/1938 | Crook | 222/529 X |
| 2,197,689 | 4/1940 | Fromm | 222/209 X |
| 2,223,611 | 12/1940 | Gross | 604/58 |
| 2,641,376 | 6/1953 | Parziale et al. | 222/529 X |
| 2,689,668 | 9/1954 | Hexel | 222/210 X |
| 2,736,469 | 2/1956 | Stone | 222/529 |
| 2,770,399 | 11/1956 | Gross | 222/211 |
| 2,805,001 | 9/1957 | Biederman | 222/211 |
| 3,185,353 | 5/1965 | Mercier | 222/206 |
| 3,187,966 | 6/1965 | Klygis | 222/541 |
| 3,570,662 | 3/1971 | Polyak | 206/438 X |
| 3,618,846 | 11/1971 | Poli | 222/206 X |
| 4,319,701 | 3/1982 | Cambio | 222/541 |
| 4,704,104 | 11/1987 | Christensen | 604/216 X |
| 4,863,014 | 9/1989 | Summons et al. | 222/541 X |
| 4,955,871 | 9/1990 | Thomas | 222/215 |
| 4,966,312 | 10/1990 | Waring | 222/209 |
| 4,979,656 | 12/1990 | Looker | 222/541 |
| 4,982,854 | 1/1991 | Ichimiya | 222/572 X |
| 5,004,128 | 4/1991 | Richichi et al. | 222/527 |
| 5,029,738 | 7/1991 | Dillon | 222/215 X |

FOREIGN PATENT DOCUMENTS

| | | | |
|---|---|---|---|
| 818297 | 8/1951 | Fed. Rep. of Germany | 222/206 |
| 2395682 | 2/1979 | France | 222/212 |

*Primary Examiner*—Andres Kashnikow
*Assistant Examiner*—Anthoula Pomrening
*Attorney, Agent, or Firm*—Keith S. Bergman

[57] ABSTRACT

An elongate peripherally defined ampule having a handle-like reservoir structurally communicating with a medial articulating element which interconnects an elongate spout to define an enclosed containment chamber. The ampule is formed of resiliently deformable material to allow dispersement of contents by manual deformation of the ampule structure and to allow accurate placement of expressed contents by manipulation of the articulating element and spout structure. The spout provides a relatively small end portion and an outwardly tapering medial channel for severance at selected positions to provide dispersement orifices of different sizes and shapes. The ampule defines a containment chamber of up to the two cubic centimeter volume range for dispersement of extrudable materials of a fluidic, gelatinous, or powdered nature, and especially for pre-measured single use quantities of chemicals, medicaments and the like. The ampule is preferably formed by molding polymeric or resinous plastic materials.

3 Claims, 1 Drawing Sheet

RESILIENT AMPULE WITH ARTICULATING LINKAGE AND ELONGATE SPOUT

BACKGROUND OF INVENTION

1. Related Applications

There are no applications related hereto heretofore filed in this or any foreign country.

2. Field of Invention

This invention relates generally to sealed ampules for containment and dispersement of pre-measured quantities of extrudable material, and particularly to such an ampule having an elongate, selectively severable spout articulately communicating with the principal ampule reservoir.

3. Background and Description of Prior Art

Ampules have long been known and used for the containment and ultimate dispersal of various chemical and medical materials, generally of a fluidic nature. Ampules have become increasingly popular since their origin as they are a simple and inexpensive means for providing pre-measured quantities of materials in an enclosed protected environment for dispersal as desired. These disposable devices have become especially popular in chemical and medical fields where contamination of materials to be dispersed prior to use is of significant concern, and in the storage of various products which may change their forms and attributes when exposed to ordinary environmental conditions. The instant invention provides an ampule which fulfills the previously required functions of such devices and additionally creates new and novel features which enhance the structure, function and reliability of the article.

An operative ampule must necessarily provide a totally enclosed material chamber which may be readily accessed for material dispersement when desired. In their inception, such devices commonly took the form of a somewhat elongated cylinder often with at least one curvilinear end. Material dispersement was accomplished generally either by forming the device from a frangible material such as glass, by providing an openable orifice, or by providing an area that might be pierced by some physical object, such as an elastomeric area that might be pierced by a hollow needle. The frangible type ampule allows a simple and unitary structure which is economic of manufacture and more certainly protective of ampule contents than either of the compound ampule structures. The compound type ampule structures are necessarily of a more complex nature which is more difficult and expensive to manufacture and normally requires the joinder of at least two components which usually are of a differing nature to provide a structure with greater potentiality of accidental opening and of invasion of foreign materials into the encapsulated material. My device provides a new and novel member of the class of simple ampules and is readily distinguishable from compound ampules by reason of the essential structural difference indicated.

As simple type ampule structures have developed and their sophistication increased, particular portions of such structures have been especially configured to aid fracturing of the capsule for dispersement of contained material. These fracturable portions have generally taken the configuration of protuberances and oftentimes have had thinned or scored areas to aid fracture or severance at particular locations. The fracture of such protuberances creates an orifice which is used for dispersement of ampule contents. In general with earlier ampules formed of rigid materials, the dispersement of ampule contents was accomplished by some secondary device such as a syringe, pipette or hypodermic needle because the rigid ampule did not provide means to allow deformable manipulation to aid expulsion of the ampule contents. In the case of fluidic materials, dispersement could sometimes be accomplished by means of gravity and appropriate orientational manipulation, but such dispersement tends to be rather haphazard and can not be well controlled unless the dispersement orifice is quite large or some secondary ventilating structure is provided, which would change the simple nature of the ampule. Spout-like devices for dispersement of ampule contents at particular locations were generally not used with rigid ampules because the ampules provided no means for expulsion of contained contents for finely defined placement.

With the advent of deformable materials and especially resiliently deformable plastic materials, it was found that capsules formed of these materials provided an advantage in allowing expulsion of capsulated material by deformable manipulation. Spout structures then came to be known in ampule structures for dispersement of encapsulated materials in relatively small predetermined areas. The end of such spout structure could constitute the frangible portion of the capsule and could move relative to the associated primary capsule structure by reason of the deformability of the spout itself.

My invention differs from this prior art by providing a resiliently deformable ampule structure having a handle-like reservoir joining an elongate spout by means of an intervening articulating structure which aids motion of the spout relative to the handle element. The elongate spout may be deformed within its own structure to some degree and may provide various curvilinear configurations if desired, though it has sufficient rigidity to maintain configurational integrity, distinguishing it from prior art devices using rubber tubing or similar flexible material for spout-like elements which will not maintain configurational integrity. The articulating linkage interconnecting the reservoir and spout elements is formed as an accordion-type bellows to provide an additional benefit of allowing collapse of the structure to further aid expulsion of the contents of the reservoir chamber during expulsive deformation thereof. Such accordion-type linkages generally have not previously been used in small ampule structures, though they are known in other types of dispersing containers.

The spout of my invention is of an elongate nature, generally as long or longer than the handle-like reservoir, and defines an outwardly truncated conic with a similar conic channel therein. The outer end portion of the spout is sealed to provide a completely enclosed ampule containment chambers so that the spout may be severed at positions spacedly inwardly of its end to open the ampule for removal of its contents. The nature of the ampule material allows severance of the spout by a sharp bladed tool, such as a knife or scissors. The tapering channel allows creation of various sized orifices and the nature of the severance may create variously configured end structures, both to aid application of controllable amounts of material at finely regulated delivery sites. Previously known ampules that have provided some sort of a spout-like structure have generally not provided any means for regulation of the size of orifice ultimately defined in the spout nor for the particular configuration of the end portion of the spout about that orifice.

The use of plastic in the formation of my ampule provides a material that may be transparent or translucent to allow dispersement of contained material in determinable amounts. To aid this function scales may be provided on the reservoir surface, the spout surfaces, or both to aid in determining amount of material dispersed. Prior ampules generally have not allowed dispersement of determinable amounts of material as they generally have not provided regulatable means for the dispersement of those materials.

My ampule is further distinguished from prior devices by allowing application of contained material in secondary small determinable areas without the use of needles or similar dispersing devices while providing all of the functions of prior ampules. Various known larger container devices for multiple dispersement of fungible materials have provided spout-like dispersement, but those devices are distinguishable in that they are not used for sealably contained, single application quantities of products in the one cubic centimeter range and have not been able to place such small quantities of material in such small areas as my ampule. In this regard it is to be particularly noted that my ampule has no needle or needle-like structure to create disposal problems, and if the device is used with dangerous or toxic substances, the spout may be resealed for disposal to prevent dispersement of residual materials still within the ampule.

Because of the expulsion of material from my ampule by reason of its configuration and resilient deformability, the device may be used with other than fluidic materials such as viscous semi-liquids, gels, colloids and even solid particulated material. The ampule may in general contain and disperse any extrudable material that will pass through an orifice defined in the spout. Generally, prior art ampules have not allowed the dispersement of such materials, either directly or by the use of secondary structures, as such materials may not be taken up, conveyed and dispensed from hypodermic needles, syringes, pipettes or the like, and cannot be effectively dispersed from the ampules themselves.

My invention lies not in any one of these features per se, but rather in the synergistic combination of all of the structures of my ampule that necessarily give rise to its functions, as herein specified and claimed.

SUMMARY OF INVENTION

My invention provides a peripherally defined, resiliently deformable, sealed ampule for the dispersement of extrudable material. The ampule provides an elongate structure with a handle-like reservoir portion, communicating at one end by an articulating accordion-like structure to an elongate spout extending a spaced distance from the reservoir. The spout is in the form of an elongate outwardly tapering truncated conic that defines a similarly shaped channel that is sealed at its smaller outermost end. The spout may be severed in selected positions to create a dispensing end of desired configuration and size. The spout is movable relative to the handle structure by reason of its articulated joinder to that structure and also by reason of its inherent resilient deformability. A species of spout provides a curvilinear configuration.

For use the spout is severed and encapsulated material dispersed by extrusion through the spout opening as aided by manual deformability of the ampule structure. After use, the tip orifice may be resealed to encapsulate any residual contents to prevent potential environmental contamination. The ampule may be used with fluidic, gelatinous, colloidal and particulated solid materials.

A principal object of the instant invention is to create a sealed single application ampule that is peripherally defined by resiliently deformable material to allow expulsion of ampule contents by manual deformation of the ampule.

A further object is to provide such an ampule that has an elongate handle-like reservoir defining a principal containment chamber with an accordion-fold type articulating structure at one end interconnecting an elongate spout for dispersement of contained product.

A further object is to provide an ampule with a spout defining a channel that tapers outwardly so that the spout may be severed spacedly inward of its end to determine a particular end configuration and orifice size.

A still further object is to provide such an ampule wherein the spout may be moved relative to the reservoir by reason of the articulating linkage interconnecting the two structures and also by reason of the resilient deformability of the spout itself.

A still further object is to provide such an ampule that by reason of its resilient deformability may disperse extrudable materials including those of a fluidic, gelatinous, colloidal and solid particulate nature.

A still further object is to provide such an ampule that is of new and novel design, of rugged and durable nature, of simple and economic manufacture and one otherwise well adapted to the uses and purposes for which it is intended.

Other and further objects of my invention will appear from the following specification and accompanying drawings which form a part hereof. In carrying out those objects, however, it is to be remembered that its accidental features are susceptible of change in design and structural arrangement with only one preferred and practical embodiment of the best known mode of my invention being illustrated and specified as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figures 1, 2, 3, 4, 5, 6:
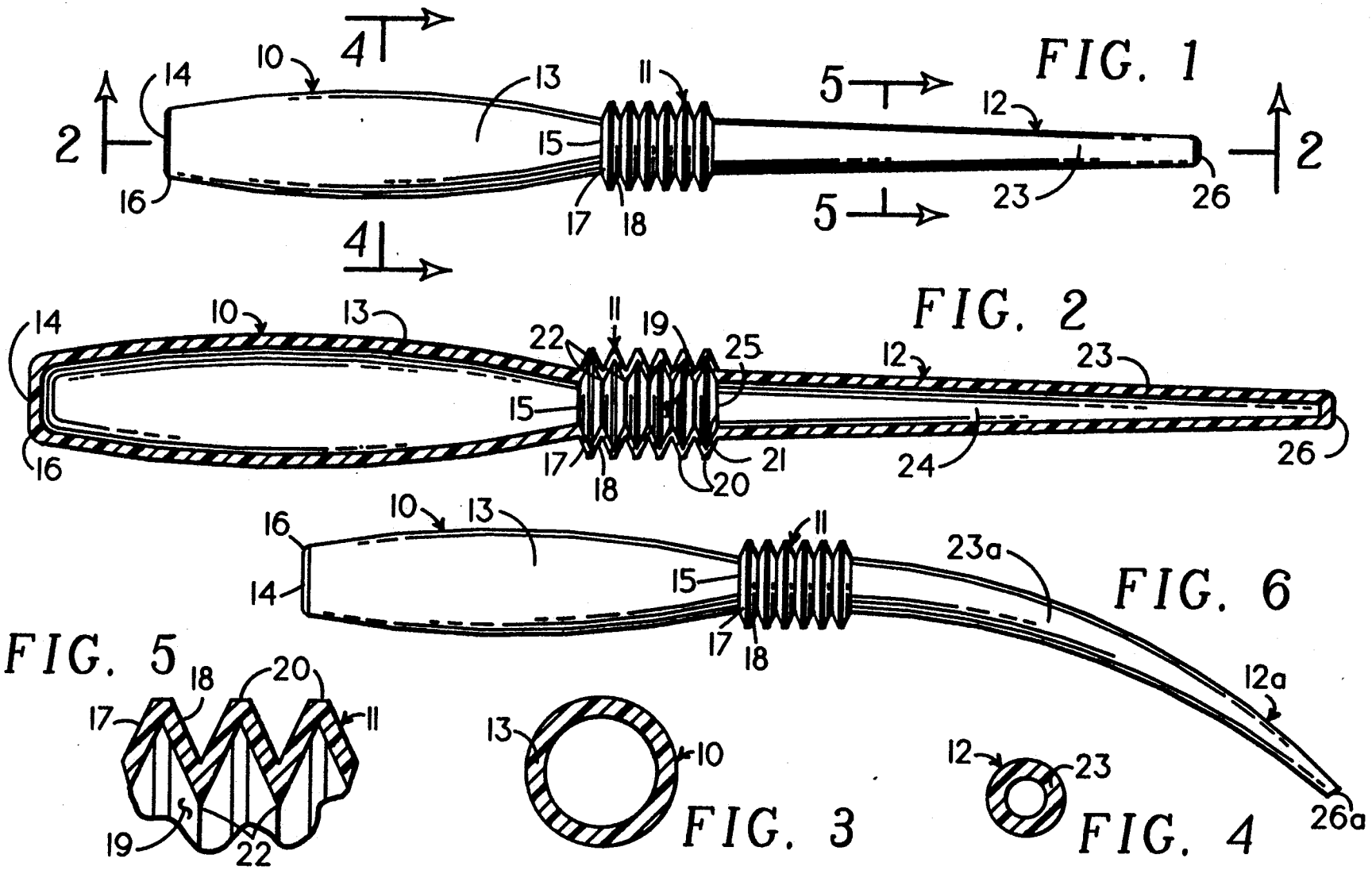
FIG. 1 is an orthographic view of my ampule showing its various parts, their configuration and relationship.
FIG. 2 is a somewhat enlarged elongate vertical cross-sectional view of the ampule of FIG. 1, taken on the line 2—2 thereon in the direction indicate by the arrows.
FIG. 3 is a somewhat enlarged traverse vertical cross-sectional view through the reservoir portion of the ampule of FIG. 1, taken on the line 4—4 thereon in the direction indicated by the arrows.
FIG. 4 is a somewhat enlarged traverse vertical cross-sectional view through the spout portion of the ampule of FIG. 1, taken on the line 5—5 thereon in the direction indicated by the arrows.
FIG. 5 is an enlarged portion of the cross-sectional view of FIG. 2, showing a portion of the articulating structure in greater detail.
FIG. 6 is an orthographic surface view of a species of my ampule having a spout formed in a curvilinear configuration.

My invention generally provides a peripherally defined, resiliently deformable ampule having elongate handle-like reservoir 10 interconnecting at one end accordion-fold type articulating linkage 11 which in turn interconnects elongate dispersement spout 12 extending spacedly from the articulating linkage.

Handle-like reservoir 10 is an elongate cylinder-like structure having side 13 formed as a surface of revolution, with areally larger medial cross-section and areally smaller ends, by revolving an arc about the medial axis of symmetry. One outer end portion of the reservoir is enclosed by end disk 14 structurally interconnected with the outer end portion of side 13. The thickness of end 14 and side 13 are substantially uniform to provide generally equal strength throughout the reservoir structure and allow relatively uniform deformation of the reservoir for expulsion of contained material. The inner end 15 of side 13 defines a circular orifice to communicate with articulating linkage 11. The outer edge 16 defined between side 13 and outer end 14 preferably is rounded as illustrated or chamfered to aid in preventing cracking or breaking in this area.

Articulating linkage 11 provides a plurality, six in the instance illustrated, of annular bellows-like elements, all peripherally defined and structurally joined to provide a manually bendable structure interconnecting the handle and spout to allow those two elements to be moved relative to each other. Each bellows-like element is formed by a peripherally defined annular truncated conic element 17 interconnected at its larger base portion with a similar annular truncated conic element 18 to define internal channel 19 extending through both bellows elements. The outer edge 20 forming the junction between annular elements 17 and 18 is chamfered or rounded as illustrated to aid in preventing cracking or breaking at this point in the ampule structure. The orifices 21 of each bellows element are of similar size and normally the same diametrical size as inner end 15 of reservoir 10 to allow simple and easy structural interconnection of the articulating linkage to the reservoir structure and of the various bellow element to each other, all as illustrated in FIG. 2.

A plurality of bellows elements 17, 18 are sequentially structurally interconnected in their end portions to form an articulating linkage as illustrated in FIG. 2. Preferably the thickness of the material from which the bellows structure is formed is reasonably uniform to allow symmetrical flexing and is no greater than the thickness of the reservoir and possibly somewhat less to aid deformable motion of the articulating element. The sharp inner edges 22 between bellows elements may also be rounded or truncated if desired, but since they comprise a part of the internal structure of the ampule they are relatively protected and generally do not exhibit the propensity toward breaking or cracking that sharp external edges do.

Dispersement spout 12 provides spout 23 configured as a truncated conic section having a large side angle to define the elongate structure illustrated in FIG. 2. Side 23 is of substantially uniform thickness to define internal channel 24 of a configuration similar to that of the spout periphery. The inner end of spout 23 defines an internal channel orifice 25 which is of similar size to orifice 21 of the adjacent articulating linkage to which the spout is structurally interconnected. The outer end portion of the spout is sealed by spout end 26. The spout outer end portion may be provided with some means to aid severance, such as a thinner area of material, a groove or the like (not shown), though such structure is not necessary and frequently not desirable as it provides a weakened portion in the ampule structure and commonly it may not be known at what point a spout might be severed for ampule opening.

The material from which my ampule is formed is critical to operation of the device. The material must be resiliently deformable and reasonably thin expanses of the material must have sufficient strength to allow deformation without rupture, sufficient semi-rigidity and retentent memory to maintain unstressed configurational conformity, sufficient elasticity to prevent fracture upon deformation and sufficient chemical inertness to prevent contamination and chemical reaction. The preferred material that ideally fulfills these requirements is one of the resinous or polymeric plastics such as the polypropylene or polyethylene compounds, polyvinyl compounds, cellulose acetate or acetatebutyrate and the like that have become known in the medical arts for containment or channelization of various medical materials. These plastics have an added benefit in that they may be readily and inexpensively formed into the specified configurations by known and existing manufacturing processes, and especially by injection molding or casting for which my ampule is configured. The plastic material also allows severance of the outer end portion of the spout with ordinary cutting tools to open the ampule for use.

Size and configuration are also critical to my ampule. The ampule is intended for single use applications of relatively small volumes of materials and its configuration and size are not well adapted to dispersement of large volumes of material because functional efficiency varies somewhat inversely as the volume of material contained and to be dispersed. The configuration of the ampule provides reservoir and spout portions of somewhat similar length, with the combined length of those two elements comprising approximately ninety percent of the total ampule length and the interconnecting articulating linkage comprising approximately ten percent of that total length. This configuration provides a reservoir of sufficient size to allow an effective handle for manual grasping and manipulation and allows appropriate spout length for manual manipulation of the spout relative to the handle structure for material placement. The overall length of my ampule, when formed with configurational similarity to the device illustrated in FIGS. 1–5, to contain approximately one cubic centimeter of liquid material is approximately 1.5 inches (3.8 cm.) with other dimensions appropriately related substantially as illustrated. This sizing allows formation of the peripheral surface of the ampule from plastic of appropriate thickness to provide and enhance the physical characteristics required of that material as hereinbefore indicated.

A second species of my invention is shown in the illustration of FIG. 6 where it is seen to provide the same handle-like reservoir 10 and articulating linkage 11 as the first species of ampule. In this second species the spout **12*a* is configured in a curvilinear fashion. The spout is of the same nature as that of the first species, with peripheral side 23*a* defining internal channel 24*a*, both of a similar outwardly tapering nature. Inner orifice 25*a* of this spout again structurally interconnects with the forward orifice of the articulating linkage. The spout end 26a** is of similar nature to that same structure of the first species. The curvilinear form of the spout sometimes allows better, more certain, and more convenient access to some locations to allow finer placement of contained materials.

Having thusly described the structure of my ampule, its use may be understood.

Firstly, an ampule is formed according to the foregoing specification. Commonly, the ampule will be formed by injection molding with an open outer end, either at the handle-like reservoir end or most commonly at the spout end 26. After formation, the material to be contained is placed in the internal chamber of the ampule. The internal chamber is of predetermined size, commonly somewhat larger than the volume of material to be contained, though this is not necessary and it is possible that that chamber may be completely filled with contained material. Contained material may be any extrudable material, including liquids of either fluidic or viscous nature, gels, colloids and various particulated solids having particles of size and nature to pass through spout channel 24. The material from which the ampule is formed and the material which it contains must be compatible so that neither appreciably degrades or destroys the other. Present day plastics used in the medical and chemical arts for material containment are suited to this purpose and present relatively few compatability problems. The containment material must also provide an impervious barrier to prevent contamination from environmental sources external of the ampule, but again the aforesaid materials generally in the case of chemicals prevent contamination by environmental gases and in the case of biologicals prevent contamination by microbal agents or viruses.

After the ampule is filled it is sealed. An appropriately shaped outer end 14 or spout end 26, as the case may be, is placed in or over the particular open orifice and structurally interconnected to the ampule structure. This structural interconnection may be accomplished by normal material joining means heretofore known, and especially by adhesion, thermal or laser welding, or similar process. Various releasable type fastening means also be used with the closing structure such as matingly interconnecting end pieces having tongue and groove elements, threads, or the like, but such devices generally are not preferred with my invention as they do not provide the security of the structurally integrated fastening means.

After the ampule is filled and closed, it provides a stable environment for storage, shipping, and transport of contained material until that material is needed for use.

For use, the ampule must be opened to allow dispersement of its contents. Opening is accomplished by severing the outer end portion of the spout structure spacedly inwardly of its outer end with some bladed cutting tool such as a knife, scissors or the like. During the severing process, the ampule may be maintained in an angulated orientation relative to the horizontal so that its contents will remain in reservoir portion 10 and will be spacedly distant from the tip portion being severed to prevent exit of contained material during the severing operation.

It is to be noted that the spout may be severed at various positions along its length, and by reason of its tapering nature and the tapering nature of the channel defined therein, and orifice of varying size and configuration may be created. The size of this orifice may be predetermined during a first severing operation or may be enlarged during a subsequent severing operation, to provide an exit orifice of desired size for particular materials and conditions. It is further to be noted that the spout may be severed perpendicularly to its axis or in various angulated configurations to provide a structure surrounding the orifice of a configuration that may aid in the application of dispersed material. The severed surface of the spout may even be configured in various complex and curvilinear fashions for particular purposes.

It is further to be noted that an ampule may be severed in the reservoir end or in other portions, but this normally is neither particularly convenient nor desirable in dispersing contained materials. The ampule also may be pierced by a needle for dispersement by this device if desired.

After opening, the ampule is manually grasped and manipulated to bring the dispersement orifice into coincidence with an area where material dispersement is to occur. In accomplishing this, it is to be noted that the handle-like reservoir provides means for manually grasping the ampule and the elongate spout allows material dispersement in varying positions at a spaced distance from the reservoir, both by reason of its attachment to the reservoir by the articulating linkage and by reason of the resilient deformability of the material from which it is formed. Such motion may be conveniently accomplished by holding the ampule in one hand and moving the spout structure with the other one finger or the other hand of a user. These features allow placement of materials in difficult and hard to reach places and also allow fine regulation of the material placement in relatively small areas and in relatively small amounts.

To cause material to be extruded from the ampule, the reservoir area is deformed by manual pressure of a user's fingers, usually the first finger and thumb, to create pressure in the reservoir chamber to move material therefrom. My ampule may also be somewhat compressed in various of its other parts, especially by moving the bellows elements together and by creating manual pressure in the inner portion of the spout. Pressure may be applied in varying degrees to cause dispersement of materials ranging from the most fluidic to viscous gels or colloids and even extending to particulated solids. In the case of some dispersements, a partial vacuum may be created within the ampule chamber. This has not been found to be a particular problem, but if it be desired to do away with any vacuum, a vent (not shown) might be provided and this is within the scope of any invention.

After use, it is possible that the ampule may be resealed to maintain any residual dangerous or environmentally deleterious materials within its structure. Resealing may be accomplished by filling the spout exit orifice with some material such as commercially available glues, caulking compounds or the like, or especially in the case of thermal plastics by thermally closing or welding the orifice. It is possible that the ampule may be provided with a separate plug or stopper, especially of an adhesive or thermal plastic nature (not shown), that could be used to close the spout exit orifice.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A sealed container for containment, storage and dispersement of relatively small, predetermined quantities of extrudable material, comprising in combination:

an elongate peripherally defined ampule formed of resiliently deformable material that has a retentent memory for configurational maintenance and is severable by a cutting tool for opening, said ampule having an elongate handle reservoir defining a material containment chamber having two ends, one of said ends defining an orifice, said reservoir structurally communicating with a resiliently deformable articulating linkage having a plurality of structurally interconnected annular bellows elements, each said bellows element formed by two similar truncated conic annuli interconnected at their bases, with the common peripheral edge between said annular elements chamfered to aid in preventing cracking and breaking, said articulating linkage defining an internal channel communicating with the material containment chamber and extending spacedly from the reservoir to structurally interconnect an elongate spout tapering outwardly from the articulating linkage and defining a similar outwardly tapering spout channel communicating with the channel of the articulating linkage, said spout channel being sealed at its outer end distal from the articulating linkage and severable selectively along its length to create orifices of differing size.

2. The ampule of claim 1 wherein:

the reservoir, articulating linkage and spout are formed as surfaces of revolution with a common linear axis of symmetry, and the axial length of the reservoir and spout each comprise at least one third of the total length of the ampule.

3. The ampule of claim 1 wherein:

the reservoir and bellows are formed as surfaces of revolution with a common linear axis of symmetry, and the spout is formed with a curvilinear axis of symmetry.

* * * * *